US006131998A

United States Patent [19]

Su

[11] Patent Number: 6,131,998

[45] Date of Patent: Oct. 17, 2000

[54] CHASSIS FOR A CHAIR SEAT

[76] Inventor: Tung-Hua Su, No. 16, Alley 23, Lane 900, Win Sheng Street, Kuel Jen, Tainan Hsien, Taiwan

[21] Appl. No.: 09/444,264

[22] Filed: Nov. 22, 1999

[51] Int. Cl.[7] ..... B60N 2/02; A47C 1/024

[52] U.S. Cl. ..... 297/374; 297/300.5

[58] Field of Search ..... 297/344.19, 374, 297/375, 303.5, 303.4, 300.5, 300.1, 300.2, 300.6, 301.4, 316

[56] References Cited

U.S. PATENT DOCUMENTS 4,830,431 5/1989 Inoue .
5,066,069 11/1991 DeGelder .
5,152,580 10/1992 Stumpf .
5,280,998 1/1994 Miotto et al. .
5,573,303 11/1996 Doerner .
5,658,045 8/1997 Van Koolwijk et al. .

*Primary Examiner*—Milton Nelson, Jr.
*Attorney, Agent, or Firm*—Charles E. Baxley

[57] ABSTRACT

A chassis is provided for a chair having a backrest and a chair seat. The chassis includes a swivel seat mounted to an underside of the chair seat, a first connecting seat, and a second connecting seat. The first connecting seat includes a mediate portion pivotally connected to a mediate portion of the swivel seat. The second connecting seat includes a first end having an upper portion pivotally connected to an end of the first connecting seat and a lower portion pivotally connected to an end of the swivel seat. The second connecting seat further includes a second end securely connected to the backrest to move therewith. When the backrest is moved rearward, the chair seat swivels through an angular displacement smaller than that of the backrest.

1 Claim, 9 Drawing Sheets

CHASSIS FOR A CHAIR SEAT

BACKGROUND OF THE INVENTION

1. Field of the Invention

The present invention relates to a chassis for a chair seat that allows adjustment in an inclination angle of the backrest relative to the seat and that provides a reliable arrangement for adjustment.

2. Description of the Related Art

A typical chassis for a chair seat is shown in FIGS. 7 and 8 and includes a swivel seat 1', a connecting seat 2', a spring seat 3', an adjusting rod 4', and a connecting rod 5'. The swivel seat 1' includes a number of holes 11' in comer areas thereof for connection with the chair seat 6', a hole 12' in a mediate portion thereof for connection with the spring seat 3', and lateral holes 13' and 14' through which the adjusting rod 4' and the connection rod 5 extend, respectively. The connecting seat 2' includes a hole 21' through which a pneumatic rod 7' extends. The connecting seat 2' further includes lateral holes 22' and 23' through which the adjusting rod 4' and the connection rod 5 extend, respectively. The connecting seat 2' further includes a hole 24' for mounting the spring seat 3'. The spring seat 3' includes a sleeve 32', a spring 31' partially mounted in the sleeve 32', and a threaded rod 33' that extends through the hole 12' in the swivel seat 1' and securely engages with a lower end of the sleeve 32'. The adjusting rod 4' includes an end 41' extended through the lateral hole 13' to restrain swivel movement of the swivel seat 1'. The adjusting rod 4' further includes a pressing section 42' to press against an' upper end of the pneumatic rod 7' to adjust the level of the chair seat 6'.

Although the seat 6' and the backrest 8' can be swiveled due to provision of the spring 31', the inclination angle of the backrest 8' relative to the seat 6' cannot be fixed. In addition, as shown in FIG. 9, the user might fall from the chair when the rearward motion of the backrest 8' goes too far, since the seat 6' swivels together with the backrest 8'.

SUMMARY OF THE INVENTION

In accordance with the present invention, a chassis is provided for a chair having a backrest and a chair seat. The chassis comprises:

- a swivel seat adapted to be mounted to an underside of the chair seat, the swivel seat including a mediate portion and an end,
- a first connecting seat including a mediate portion pivotally connected to the mediate portion of the swivel seat and an end, and
- a second connecting seat including a first end having an upper portion pivotally connected to the end of the first connecting seat and a lower portion pivotally connected to the end of the swivel seat, the second connecting seat further including a second end adapted to be securely connected to the backrest to move therewith, whereby when the backrest is moved rearward, the chair seat swivels through an angular displacement smaller than that of the backrest.

A spring seat is mounted to an underside of the first connecting seat. The spring seat includes a sleeve, a spring partially mounted in the sleeve, and a threaded rod that extends from an upper side of the swivel seat and passes through the swivel seat with a threaded end of the threaded rod engaged with the sleeve.

A level-adjusting rod has an inner end retained in the first connecting seat and an outer end for manual operation. The inner end of the level-adjusting rod includes a portion that bears against a pneumatic rod that supports the swivel seat. The first connecting seat includes a hole through which the pneumatic rod extends to support an underside of the swivel seat.

In a preferred embodiment of the invention, the swivel seat includes two extensions. The second connecting seat includes two lateral walls each having an upper hole and a lower hole of an end thereof. A knob is extended through each upper hole. Two follower plates are provided and each includes an upper end engaged with an associated knob and a lower end pivotally connected to the first connecting seat. An arcuate slot is defined in one of the lateral walls of the second connecting seat. An axle rod is extended through the second holes of the second connecting seat and through the extensions of the swivel seat. The first connecting seat further includes an engaging section with two walls defining a compartment.

The chassis further includes a locking mechanism including:

- a connecting rod extended through the engaging section of the first connecting seat and the arcuate slot such that the engaging section of the first connecting seat is slidable relative the second connecting seat under guided sliding movement of the connecting rod along the arcuate slot,
- an adjusting rod having a first end securely engaged with the connecting rod to move therewith and a second operative end,
- a plurality of locking plates and a plurality of engaging plates alternately disposed on the connecting rod, wherein each said locking plate including a first end with a slot through which the connecting rod extends, each said locking plate flier including a second end with a hole through which the axle rod extends, and
- a pressing tube mounted around the connecting rod and extended through one of the walls of the engaging seat and through the arcuate slot, the pressing tube being movable along a longitudinal direction of the connecting rod, upon manual rotation of the adjusting rod, between a first position that bears against the locking plates and the engaging plates for securely connecting the engaging seat of the first connecting seat with the second connecting seat and a second position that allows free relative pivotal movement between the engaging seat of the first connecting seat and the second connecting seat.

The chair seat swivels through a smaller angle although the backrest swivels through a considerable angle, thereby providing a stable chair. The stability of the chair is further assured under provision of the follower plates. The arcuate slot in the second connecting seat retrains maximum rearward inclination angle of the backrest that is connected to the second connecting seat. The backrest may be adjusted to a desired inclination angle relative to the seat, thereby providing comfort sitting.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
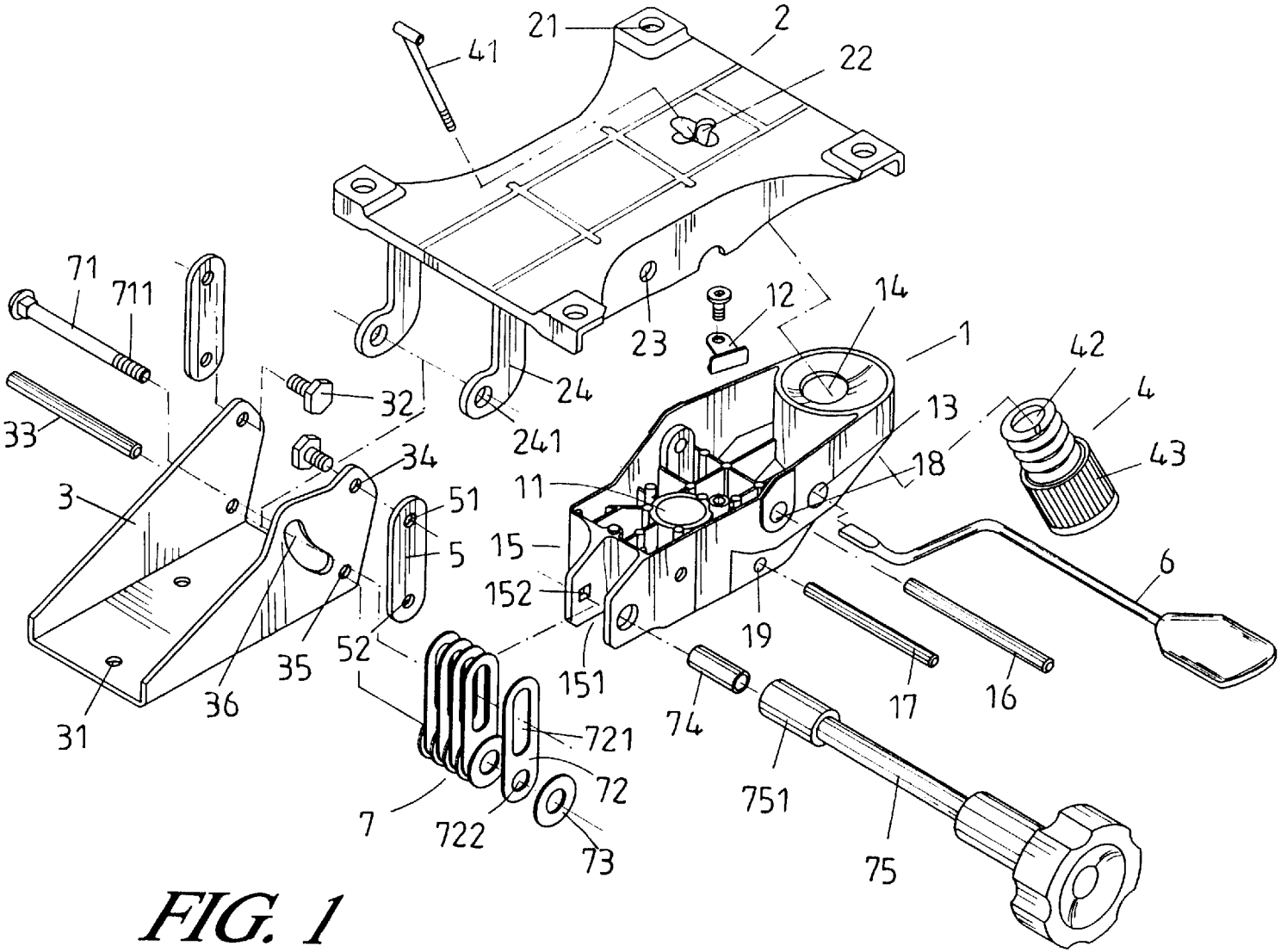
FIG. 1 an exploded perspective view of a chair seat chassis in accordance with the present invention.
Figure 2:
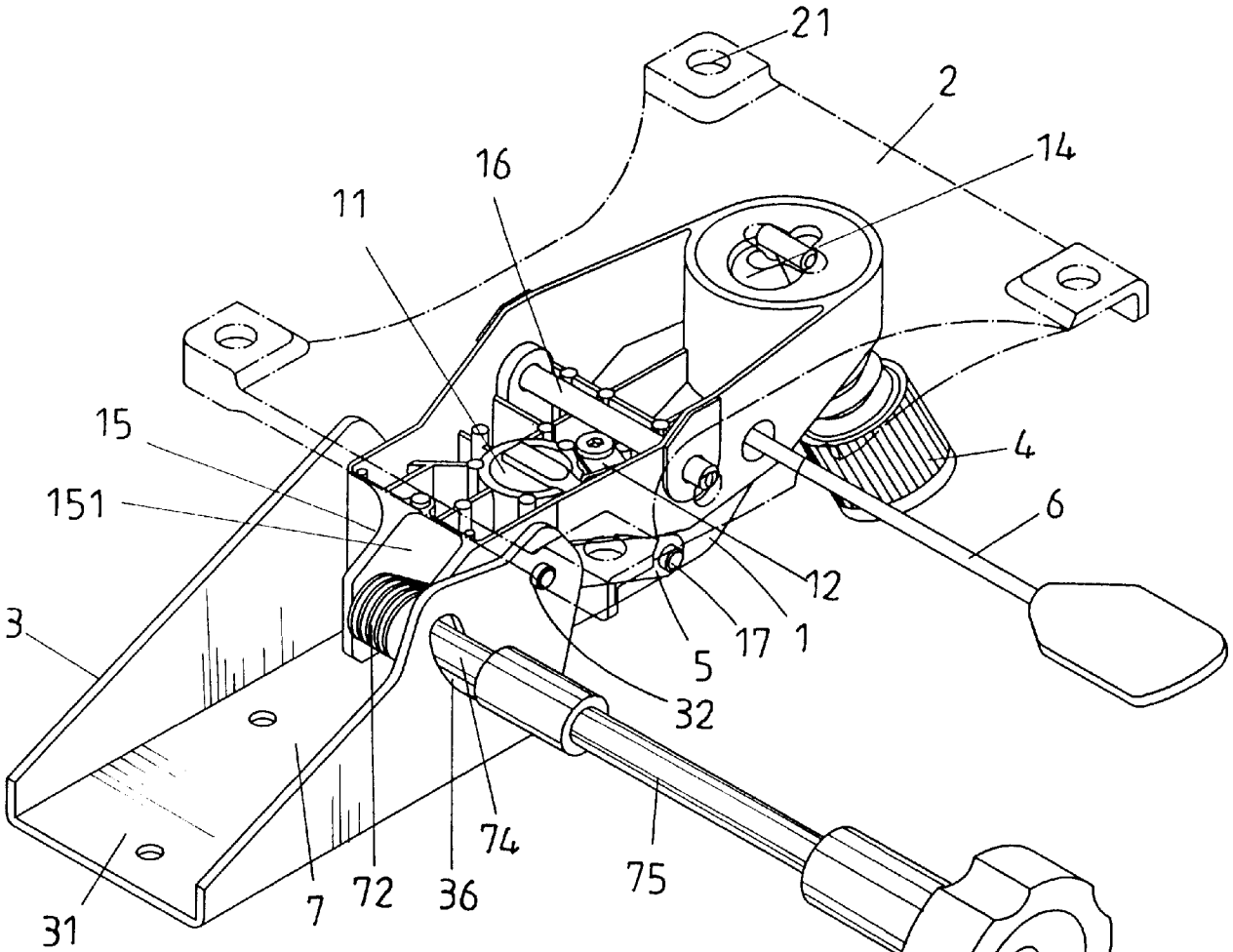
FIG. 2 is a perspective view of the chair seat chassis in accordance with the present invention.

Referring to FIGS. 1 through 6 and initially to FIGS. 1 and 2, a chair seat chassis in accordance with the present invention generally includes a first connecting seat 1, a swivel seat 2, a second connecting seat 3, a spring seat 4, two follower plates 5, a level-adjusting rod 6, and a locking mechanism 7. The first connecting seat 1 includes a hole 11 in a mediate portion thereof through which a pneumatic rod 8 (FIG. 4) extends. A through-hole 13 is defined in a lateral side of the first connecting seat 1. The adjusting rod 6 is extended through the through-hole 13 and includes an end engaged with a connecting piece 12 that is securely mounted in the mediate portion of the first connecting seat 1. The first connecting seat 1 further includes a hole 14 in an end thereof and an engaging section 15 formed on the other end thereof for engaging with the locking mechanism 7. The engaging section 15 includes a compartment 151 and aligned axle holes 152 in two lateral walls (not labeled) that define the compartment 151.

Figure 4:
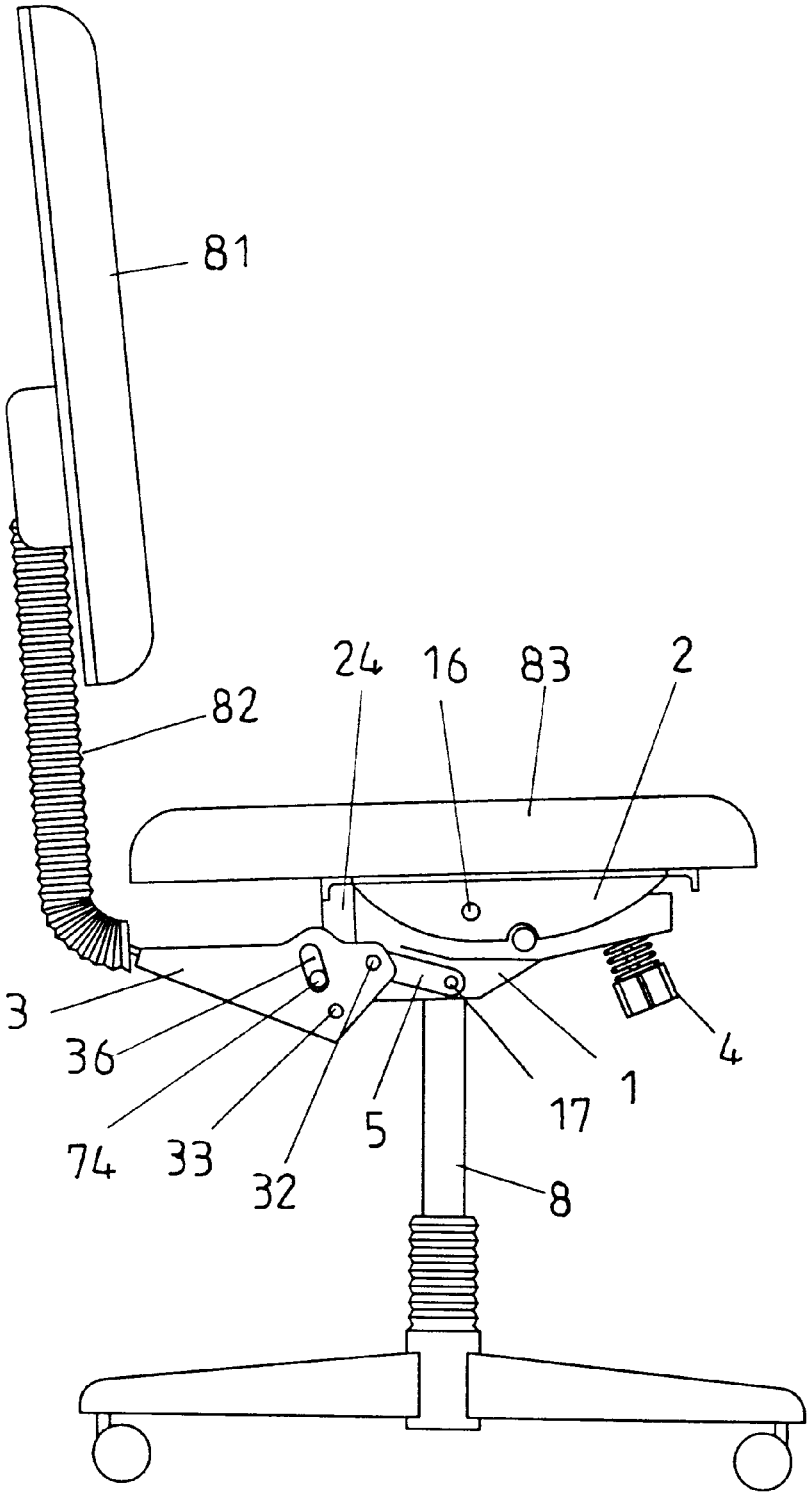
FIG. 4 is a side view of a chair with the chair seat chassis in accordance with the present invention.

The swivel seat 2 includes a number of holes 21 in corner areas thereof for connection with a chair seat 83 (FIG. 4). The swivel seat 2 further includes a hole 22 that aligns with the hole 14 of the swivel seat 1. The swivel seat 2 further includes aligned axle holes 23 for connection with the first connecting seat 1 by an axle rod 16. The swivel seat 2 further includes two extensions 24 projected downwardly from an end thereof and having aligned axle holes 241.

The second connecting seat 3 includes an engaging section 31 at an end thereof. The other end of the connecting seat 3 includes aligned axle holes 35 in two lateral sides thereof. An axle rod 33 extends through the axle hole 35 and 241 for connecting the second connecting seat 3 with the swivel seat 2. The other end of the connecting seat 3 further includes aligned holes 34 above the holes 35, wherein a knob 32 extends through each hole 34 for engaging with an associated follower plate 5. The second connecting seat 3 further includes an arcuate slot 36 in one of the lateral sides thereof through which a pressing tube 74 of the locking mechanism 7 extends.

The spring seat 4 includes a threaded rod 41, a spring 42, and a sleeve 43 and is connected to a front end of an underside of the first connecting seat 1. The follower plates 5 are mounted to two lateral sides of the first connecting seat 1 and each includes a first hole 51 in a first end thereof for pivotal connection with the second connecting seat 3 by the knob 32 and a second hole 52 in a second end thereof for pivotal connection with the first connecting seat 1 by an axle rod 17.

Figure 3:
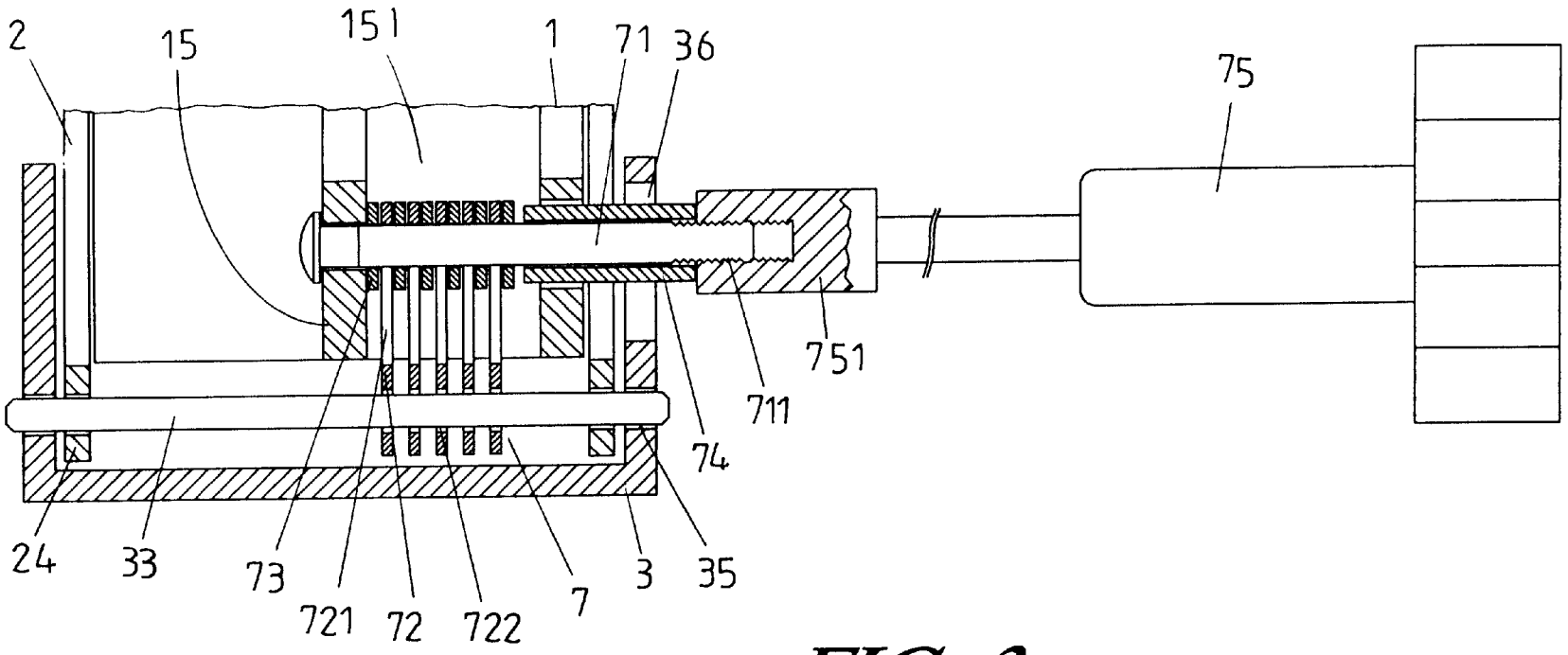
FIG. 3 is a sectional view of a locking mechanism of the chair seat chassis in accordance with the present invention.

The locking mechanism 7 includes a connecting rod 71, a number of locking plates 72, a number of engaging plates 73, a pressing tube 74, and an adjusting rod 75. Referring to FIGS. 1 and 3, the connecting rod 71 is extended through axle holes 152 of the engaging section 15 of the swivel seat 1 and the arcuate slot 36 of the second connecting plate 36. The connecting rod 71 includes a threaded end 711 for threadedly engaging with an end 751 of the adjusting rod 75. The locking plates 72 and the engaging plates 73 are alternately disposed on the connecting rod 71 and located in the compartment 151 of the first connecting seat 1. Each locking plate 72 includes a slot 721 in an upper end thereof through which the connecting rod 71 extends and an axle hole 722 in a lower end thereof. The axle rod 33 of the second connecting seat 3 is extended through the axle hole 722 of each locking plate 72. The pressing tube 74 is around a portion of the connecting rod 71 in a manner that when the adjusting rod 75 tightened upon manually rotating an operative end of the adjusting rod 75, a side of the pressing tube 74 provides a lateral pressing force to make the locking plates 72 and the engaging plates 73 in a locked status (FIG. 6).

In assembly, an inner end of the level-adjusting rod 6 is securely attached to the connecting piece 12 in the swivel seat 1 in a manner that a front portion of the level-adjusting rod 6 presses against an upper end of the pneumatic rod 8 that supports the swivel seat 2 secured to an underside of the seat 83. Axle rod 16 is extended through the first connecting seat 1 to connect with the swivel seat 2. Axle rod 17 is extended through the first connecting seat 1 to connect with the second end of each follower plate 5. Knobs 32 are provided to front end of the second connecting seat 3 to connect with the first end of each follower plate 5. Axle rod 33 is extended through the front end of the second connecting seat 3 to connect with the extensions 24 of the swivel seat 2. Thus, the swivel seat 2 is actuated when the second connecting seat 3 is moved. The spring seat 4 is mounted to the front end of the underside of the first connecting seat 1 to provide elastic force for swiveling. The locking mechanism 7 is mounted to the engaging section 15 of the first connecting seat 1 and the front end of the second connecting seat 3.

Figure 5:
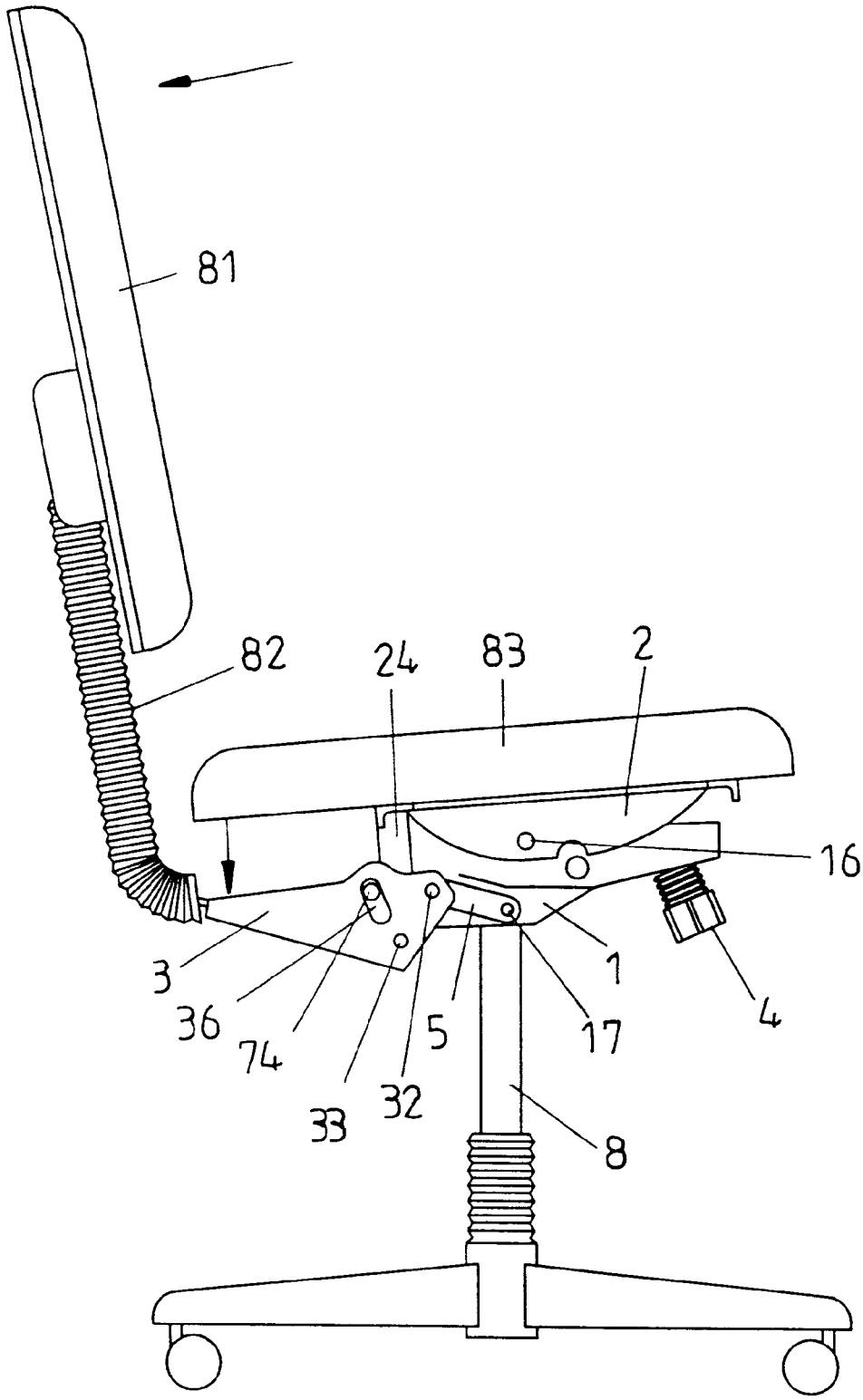
FIG. 5 is a side view similar to FIG. 4, illustrating swivel motion of the chair.

Referring to FIG. 5, when the user leans rearward against the backrest 81 that is connected to the second connecting seat 3 via a connecting member 82, the seat 83 is swiveled by a smaller extent due to provision of the above-mentioned structure, thereby keeping the chair in a more stable status. Namely, the swivel seat 2 swivels by an angular displacement smaller than that of the second connecting seat 3. The follower plates 5 assure stable rearward motion of the second connecting seat 3 during operation of the chassis. In addition, when the second connecting seat 3 inclines rearward through a larger angle, the pressing tube 74 bears against an end edge of the arcuate slot 36 to thereby restrain maximum rearward inclination angle of the backrest 81. This further assures stability of the chair.

Figure 6:
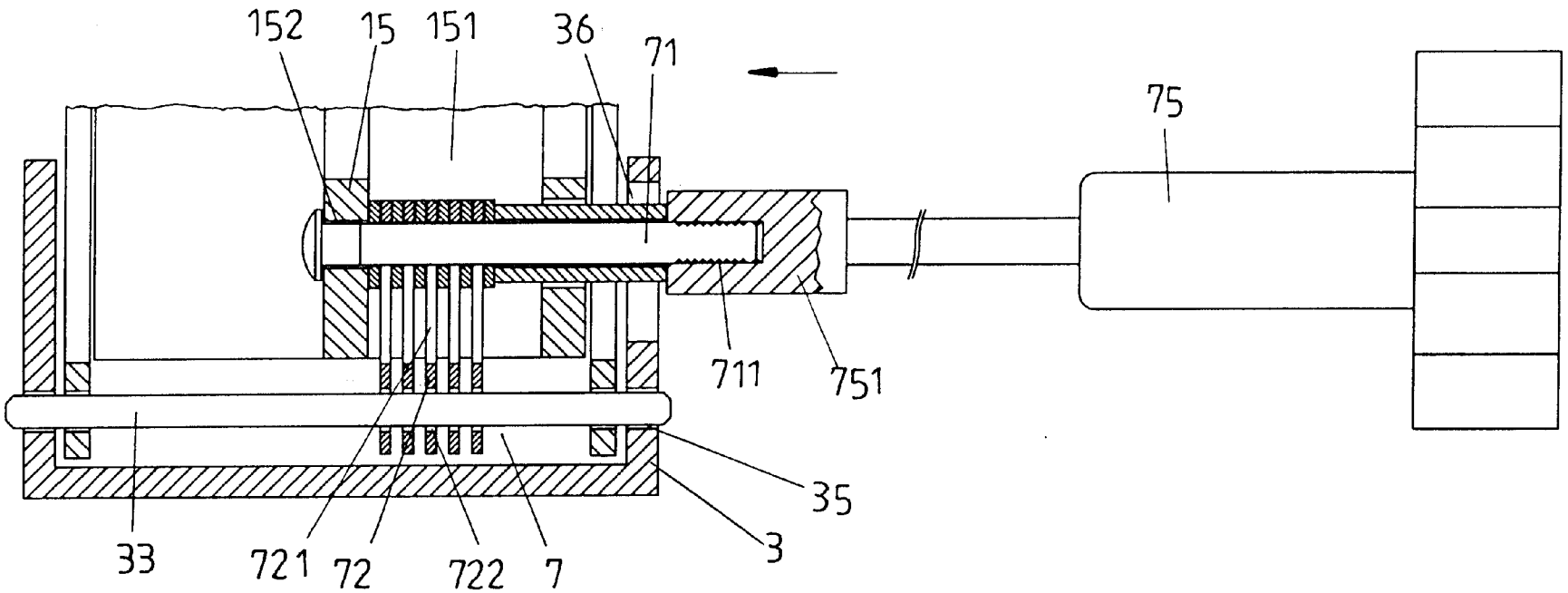
FIG. 6 is a sectional view similar to FIG. 3, wherein the locking mechanism is in a locked status.
Figure 7:
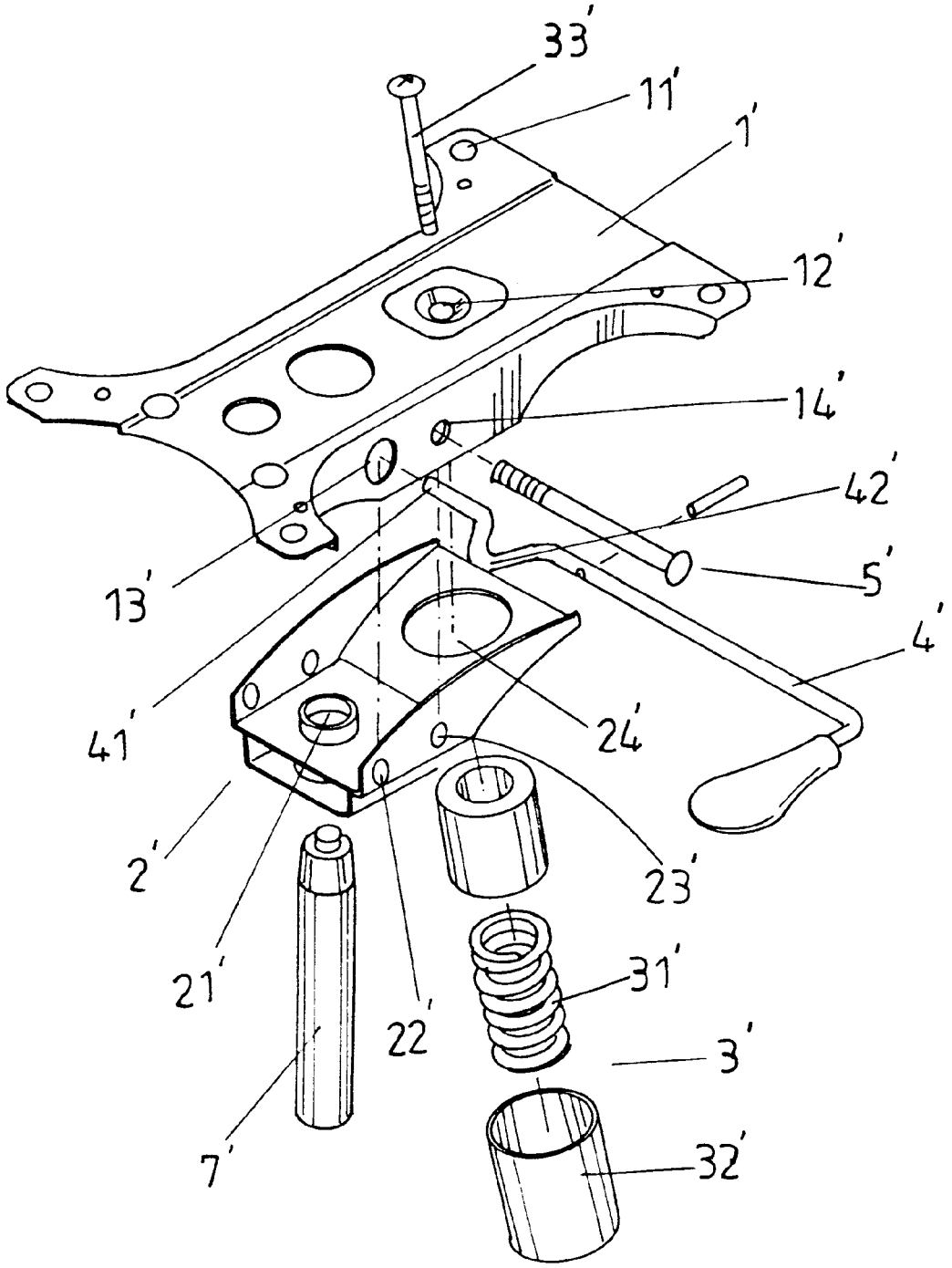
FIG. 7 is an exploded perspective view of a conventional chair seat chassis.
Figure 8:
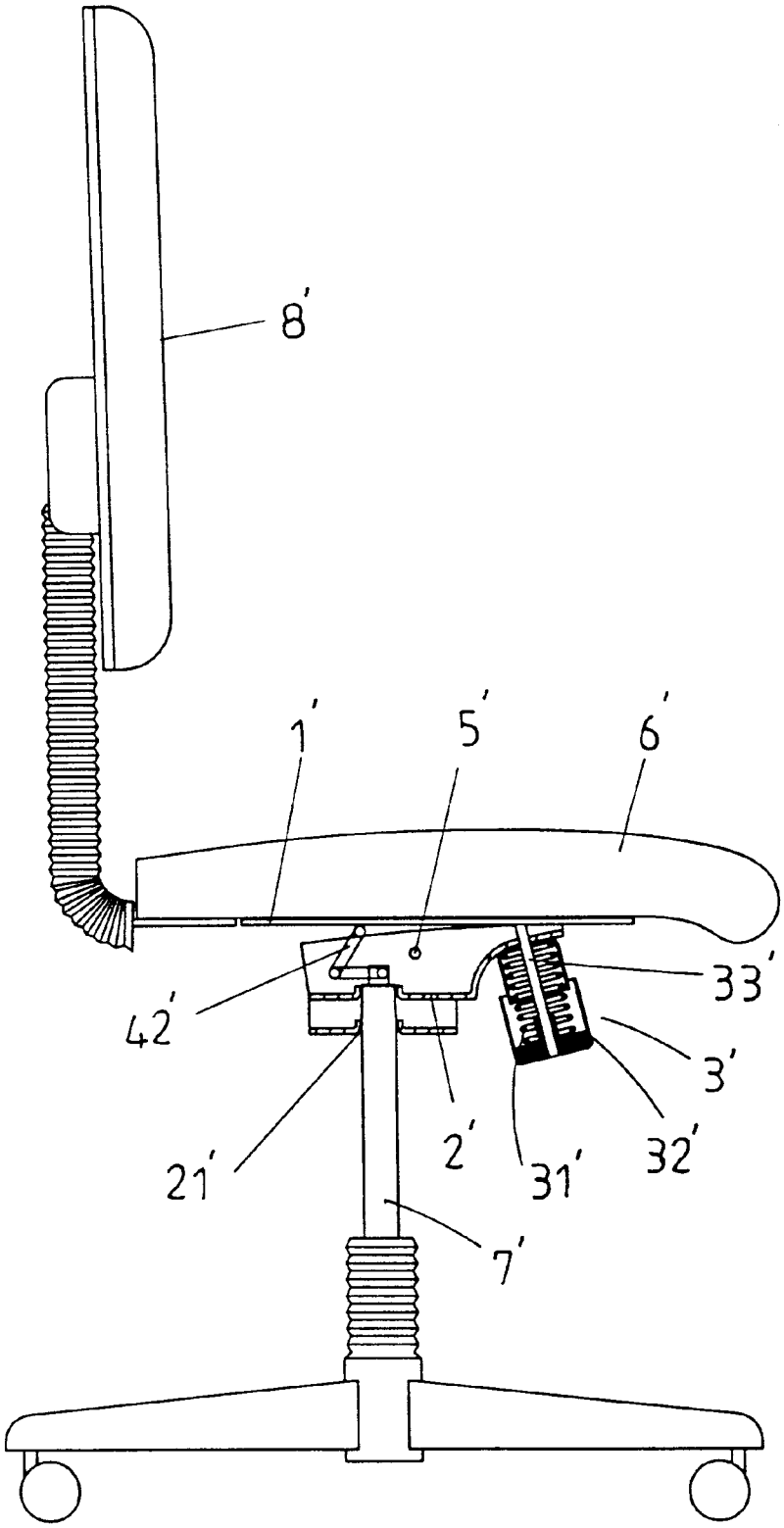
FIG. 8 is a side view of a chair with the conventional chair seat chassis in FIG. 7.
Figure 9:
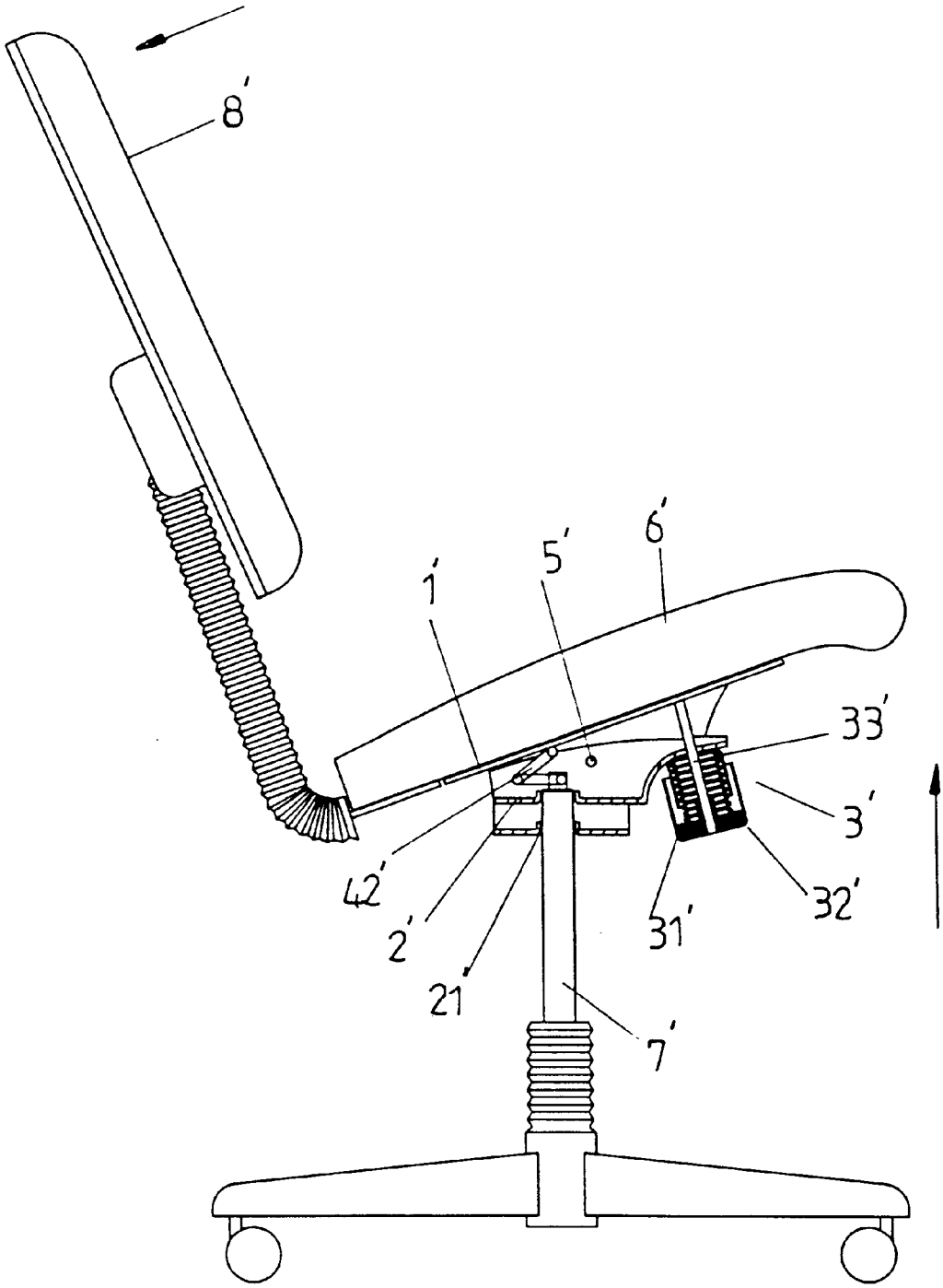
FIG. 9 is a side view illustrating use of the chair in FIG. 8.

Referring to FIG. 6, when the user leans rearward to make the backrest 81 in a desired inclination angle relative to the seat 83, the adjusting rod 75 is rotated to cause the pressing tube 74 to bear against the locking plates 72 and the engaging plates 73, thereby securely engaging with the engaging section 15 of the first connecting seat 1. The second connecting seat 3 may be retained in place, as two ends of each locking plate 72 are retained between the axle rod 33 of the second connecting seat 3 and the engaging seat 1 of the first connecting seat 1. Thus, the backrest 81 may be retained in a desired inclination angle relative to the seat 83.

According to the above description, it is appreciated that the chair seat swivels through a smaller angle although the backrest swivels through a considerable angle, thereby providing a stable chair. The stability of the chair is further assured under provision of the follower plates. The arcuate slot in the second connecting seat retrains maximum rearward inclination angle of the backrest that is connected to the second connecting seat. The backrest may be adjusted to a desired inclination angle relative to the seat, thereby providing comfort sitting.

Although the invention has been explained in relation to its preferred embodiment, it is to be understood that many other possible modifications and variations can be made without departing from the spirit and scope of the invention as hereinafter claimed.

What is claimed is:

1. A chassis for a chair having a backrest and a chair seat, the chassis comprising:

a swivel seat adapted to be mounted to an underside of the chair seat, the swivel seat including a mediate portion and an end;

a first connecting seat including a mediate portion pivotally connected to the mediate portion of the swivel seat and an end;

a second connecting seat including a first end having an upper portion pivotally connected to the end of the first connecting seat and a lower portion pivotally connected to the end of the swivel seat, the second connecting seat further including a second end adapted to be connected securely to the backrest to move therewith, whereby when the backrest is moved rearwardly, the chair seat swivelable through an angular displacement smaller than that of the backrest;

the swivel seat including two extensions, the second connecting seat including two lateral walls each defining an upper hole and a lower hole in an end of each of the walls:

a knob extending through each of said upper holes, two follower plates being provided and each of the follower plates including an upper end engaged with an associated one of said knobs and a lower end pivotally connected to the first connecting seat, an arcuate slot being defined in one of the lateral walls of the second connecting seat;

an axial rod being extendable through the lower holes of the second connecting seat and through the extensions of the swivel seat;

the first connecting seat further including an engaging section with two walls defining a compartment, further comprising a locking mechanism including:

a connecting rod extending through the engaging section of the first connecting seat and the arcuate slot such that the engaging section of the first connecting seat is slidable relative to the second connecting seat under guided sliding movement of the connecting rod along the arcuate slot;

an adjusting rod having a first end securely engaged with the connecting rod to move therewith and a second operative end;

a plurality of locking plates and a plurality of engaging plates alternately disposed on the connecting rod, wherein each said locking plate includes a first end with a slot through which the connecting rod extends, each of said locking plates further including a second end with a hole through which the axial rod extends; and a pressing tube mounted around the connecting rod and extending through one of the walls of the engaging seat and through the arcuate slot, the pressing tube being movable along a longitudinal direction of the connecting rod, upon manual rotation of the adjusting rod, between a first position wherein the pressing tube bears against the locking plates and the engaging plates for securely connecting the engaging seat of the first connecting seat with the second connecting seat and a second position that allows free relative pivotal movement between the engaging seat of the first connecting seat and the second connecting seat.

* * * * *